US010814194B1

(12) United States Patent
Balnis

(10) Patent No.: US 10,814,194 B1
(45) Date of Patent: Oct. 27, 2020

(54) GOLF GRIP WITH STABLE MECHANICAL PROPERTIES

(71) Applicant: Eaton Intelligent Power Limited, Dublin (IE)

(72) Inventor: Craig R. Balnis, Aberdeen, NC (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/526,884

(22) Filed: Jul. 30, 2019

(51) Int. Cl.
*A63B 53/14* (2015.01)
*A63B 60/08* (2015.01)

(52) U.S. Cl.
CPC ..... *A63B 60/08* (2015.10); *A63B 53/14* (2013.01)

(58) Field of Classification Search
CPC ..... A63B 60/08; A63B 53/14; A63B 60/14
See application file for complete search history.

(56) References Cited

U.S. PATENT DOCUMENTS 5,569,858 A * 10/1996 Askea ..... G01N 3/32 73/789
5,712,038 A * 1/1998 Yamazaki ..... B32B 25/10 428/411.1
5,965,249 A * 10/1999 Sutton ..... C08J 9/40 248/562
6,033,370 A * 3/2000 Reinbold ..... A61B 5/6806 600/595
8,506,418 B2 * 8/2013 Tremulis ..... A63B 53/14 473/300
8,653,195 B2 * 2/2014 Blok ..... B60C 1/00 525/191
9,469,158 B2 * 10/2016 Tanabe ..... B60C 1/00
9,676,094 B1 6/2017 Davis et al.
9,951,197 B2 * 4/2018 Yukimura ..... C08J 3/20
2004/0043828 A1 * 3/2004 Goldfader ..... A63B 53/14 473/303
2012/0059121 A1 * 3/2012 Backer ..... C08K 5/5425 524/856

(Continued)

OTHER PUBLICATIONS

R. J. Shaeffer, "Mechanical properties of rubber," web publication at https://www.mtec.or.th/wp-content/uploads/2018/04/mechanical-properties_rubber.pdf, downloaded on Jul. 22, 2019.

(Continued)

*Primary Examiner* — Stephen L Blau
(74) *Attorney, Agent, or Firm* — Mei & Mark, LLP

(57) ABSTRACT

A golf grip comprising an elastomeric material that has a change in the storage modulus of less than about 0.01 MPa in a range of 1% to 4% strain in a subsequent test cycle after an initial test cycle in a dynamic strain test, or alternatively, a change in storage modulus of less than about 0.007 MPa at 2.5% strain between the initial test cycle and the subsequent test cycle. The elastomeric material has less than about 2.5% change in modulus when strained to 300% under a uniaxial static strain in a subsequent test cycle comparing to an initial test cycle under a static strain cycle test. The elastomeric material may have a storage modulus of less than about 1.5 MPa at 2.5% strain and hardness of less than approximately 35 durometer on shore A scale. The golf grip may be a single or multiple layered, and preferably, a rubber vulcanizate.

22 Claims, 3 Drawing Sheets

| TEST SAMPLE | ΔE' (1-4% STRAIN) (MPA) | | ΔE' (2.5% STRAIN) (MPA) |
|---|---|---|---|
| | CYCLE 1 | CYCLE 2 | (CYCLE 1- CYCLE 2) |
| PRESENT INVENTION | 0.0174 | 0.0024 | 0.0010 |
| COMPARATIVE 1 | 0.2931 | 0.2563 | 0.0144 |
| COMPARATIVE 2 | 0.0416 | 0.0253 | 0.0297 |

(56) References Cited

U.S. PATENT DOCUMENTS

2018/0291124 A1* 10/2018 Anderson ..... C08F 8/14

OTHER PUBLICATIONS

Mullins, L. "Softening of Rubber by Deformation," Rubber Chemistry and Technology, vol. 42, No. 1, pp. 339-362 (Mar. 1969).
Payne, A. R., "The Dynamic Properties of Carbon Black Loaded Natural Rubber Vulcanizates. Part II," Journal of Applied Polymer Science, vol. VI, Issue No. 21, pp. 368-372 (1962).
Payne, A.R., "The Dynamic Properties of Carbon Black-Loaded Natural Rubber Vulcanizates. Part I," Journal of Applied Polymer Science; vol. VI, Issue No. 19; pp. 57-63 (1962).

* cited by examiner

| TEST SAMPLE | ΔE' (1-4% STRAIN) (MPA) | | ΔE' (2.5% STRAIN) (MPA) |
|---|---|---|---|
| | CYCLE 1 | CYCLE 2 | (CYCLE 1-CYCLE 2) |
| PRESENT INVENTION | 0.0174 | 0.0024 | 0.0010 |
| COMPARATIVE 1 | 0.2931 | 0.2563 | 0.0144 |
| COMPARATIVE 2 | 0.0416 | 0.0253 | 0.0297 |

| Samples | | Stress at 300% strain (psi) | | Change in cycle 1-cycle 2 (psi) | % of change in cycle 1-cycle2/cycle 1 |
|---|---|---|---|---|---|
| | | cycle 1 | cycle 2 | | |
| present invention | PS1-1 | 70.0 | 68.6 | 1.4 | 2% |
| | PS1-2 | 63.2 | 63.2 | 0 | 0 |
| comparative samples | CS3-1 | 359.2 | 316.2 | 43 | 12% |
| | CS3-2 | 371.3 | 333.7 | 37.6 | 10% |

FIG. 4

GOLF GRIP WITH STABLE MECHANICAL PROPERTIES

FIELD OF TECHNOLOGY

The present invention relates to golf grips, particularly, golf grips made of softer elastomeric materials that have stable mechanical properties.

BACKGROUND

A wide variety of golf grips have been employed over the years: some are formed of a single layer of material secured on the upper end of the shaft of a golf club, while others are formed of layers of different materials arranged on the end of the shaft. The construction and mechanical properties of a golf grip are critical particularly when softer material are used for the golf grip.

Generally, golfers prefer golf grips exhibiting a feel of fitting in the hands while gripping, describing it as a "fit feel" or a "grasp feeling." Such a feel may be improved by using a material for the golf grip with low hardness. Softer materials allow the fingers and hands to embed into the golf grip, increasing the surface area of contact, and improve the friction between the hands and the grip surface. However, softer materials are susceptible to permanent deformation. The rules of golf equipment require the grip have resilient properties, meaning the grip material must return to the original state and be elastic. Furthermore, significant deformation may lead to deterioration in the swing form such that the direction of the hit ball may greatly deviate from the direction desired by the golfer.

Improvements on the structure and composition of the golf grip have been known. However, no compound has been prepared based on the stress-strain behavior of the material for the golf grip for selecting or improving the mechanical properties of the golf grips.

The Payne effect and the Mullins effect are features of the stress-strain behavior of rubber material showing frequency-dependent and amplitude-dependent dynamic stiffness and damping. The Payne effect is observed under cyclic loading conditions with small strain amplitude and is manifest as a decrease of the viscoelastic storage modulus on the amplitude of the applied strain. See Payne, "The dynamic properties of carbon black loaded natural rubber vulcanizates," Journal of Applied Polymer Science, Part I at Vol. VI, Issue No. 19, pp. 57-63 (1962) and Part II at Vol. VI, Issue No. 21, pp. 368-272 (1962). The Mullins effect is observed and may be described as an instantaneous and irreversible softening of the stress-strain curve that occurs whenever the load increases beyond its prior all-time maximum value, while at times, nonlinear elastic behavior prevails when the load is less than a prior maximum. See L. Mullins, "Softening of rubber by deformation," Rubber Chemistry and Technology, Vol. 42, No. 1, pp. 339-362 (March 1969). Both Payne and Mullins effects may be attributed to deformation-induced changes, including the breakage and recovery of weak physical bonds, in the microstructure of the materials. There has been no known study for selecting materials based on these effects and the mechanical properties of the materials for the golf grip.

SUMMARY

Based on the study of the stress-strain behavior and constructive model of the materials under the dynamic mechanical study and static strain cycling study, the present disclosure provides a golf grip that is made of an elastomeric material that exhibits stable mechanical properties with reduced strain softening after successive strain cycles. The reduction in the strain softening of the elastomeric materials provides the golfer with a unique feel of stability with improved mechanical conformation to the user's hand yet the golf grip is soft and comfortable to grip.

The golf grip disclosed herein comprises an elastomeric material, wherein the elastomeric material has a change in storage modulus of less than approximately 0.01 MPa in a range of 1% to 4% strain in a subsequent test cycle after an initial test cycle in a dynamic strain test. Preferably, the elastomeric material for making the golf grip has a change in storage modulus of less than approximately 0.005 MPa, and more preferably, less than approximately 0.0025 MPa, in the range of 1% to 4% strain in a subsequent test cycle after an initial test cycle in a dynamic strain test. Further, the elastomeric material for making the golf grip has a change in storage modulus of less than approximately 0.007 MPa at 2.5% strain between the initial test cycle and the subsequent test cycle in the dynamic strain test. Preferably, the elastomeric material for making the golf grip has a change in storage modulus of less than approximately 0.0035 MPa, and more preferably, a change in storage modulus of less than approximately 0.0015 MPa at 2.5% strain between the initial test cycle and the subsequent test cycle in the dynamic strain test.

Alternatively, in the present disclosure, the golf grip disclosed herein comprises an elastomeric material, wherein the elastomeric material has a change in storage modulus of less than approximately 0.007 MPa between an initial test cycle and a subsequent test cycle at 2.5% strain in a dynamic strain test. Preferably, the elastomeric material for making the golf grip has a change in storage modulus of less than approximately 0.0035 MPa, and more preferably, a change in storage modulus of less than approximately 0.0015 MPa at 2.5% strain between the initial test cycle and the subsequent test cycle in the dynamic strain test. Further, the elastomeric material can have a change in storage modulus of less than approximately 0.01 MPa in a range of 1% to 4% strain in the subsequent test cycle after the initial test cycle in the dynamic strain test. Preferably, the elastomeric material for making the golf grip has a change in storage modulus of less than approximately 0.005 MPa, and more preferably, less than approximately 0.0025 MPa, in the range of 1% to 4% strain in the subsequent test cycle after the initial test cycle in the dynamic strain test.

In the present disclosure, the elastomeric material for making the golf grip has less than approximately 5% change, and preferably less than approximately 2.5% change, in modulus, when strained to 300% under a uniaxial static strain in a subsequent test cycle comparing to an initial test cycle under a static strain cycle test.

Further, the elastomeric material for making the golf grip disclosed herein has a storage modulus of less than approximately 1.5 MPa, and preferably, a storage modulus of less than approximately 1.0 MPa, at 2.5% strain.

Furthermore, the hardness of the elastomeric material is less than approximately 35 durometer on the Shore A scale, preferably, less than approximately 33 durometer on the Shore A scale, and more preferably, less than approximately 31 durometer on the Shore A scale. In one embodiment of the present invention, the elastomeric material has 30 durometer on the Shore A scale.

In the present disclosure, the golf grip may comprise one or more layers, and at least one of the layers comprises the elastomeric material. In one embodiment of the invention, the golf grip comprises a surface layer that is in contact with a user which comprises the elastomeric material. In another embodiment of the invention, the golf grip comprises an inner layer being fit over a shaft of a golf club which comprises the elastomeric material.

The elastomeric material for making the golf grip can be styrene-butadiene copolymers, ethylene-propylene-diene copolymers, polyisoprene, polybutadiene, thermoplastics polyisobutylene, polyisobutylene-isoprene copolymers, halogenated polyisobutylene-isoprene copolymers, nitrile-butadiene copolymers, or a combination thereof. Preferably, the elastomeric material is a rubber vulcanizate, and the rubber vulcanizate comprises a rubber and rubber additives. The amount of the rubber additives in the rubber vulcanizate can range from approximately 0.01 to 120 parts per 100 parts of the rubber, and the rubber additives can be filler, silica, protecting agent, tackifier, processing aid, pigment, activator, accelerator, vulcanizing agent, or a combination thereof.

The present disclosure further provides an elastomeric material having a change in storage modulus of less than approximately 0.01 MPa in a range of 1% to 4% strain in a subsequent test cycle after an initial test cycle in a dynamic strain test. Further, the elastomeric material can have a change in storage modulus of less than approximately 0.007 MPa at 2.5% strain between the initial test cycle and the subsequent test cycle in the dynamic strain test. Further, the elastomeric material can have a less than approximately 5% change in modulus when strained to 300% under a uniaxial static strain in a subsequent test cycle comparing to an initial test cycle under a static strain cycle test. Moreover, the elastomeric material can have a storage modulus of less than approximately 1.5 MPa. Furthermore, the elastomeric material can have a hardness of less than approximately 35 durometer on the Shore A scale.

BRIEF DESCRIPTION OF THE DRAWINGS

FIG. 4 is a table showing data on the static strain softening analysis on samples PS1-1, PS1-2, CS3-1, and CS3-2 in Example 3.

DETAILED DESCRIPTION

Figure 1A:
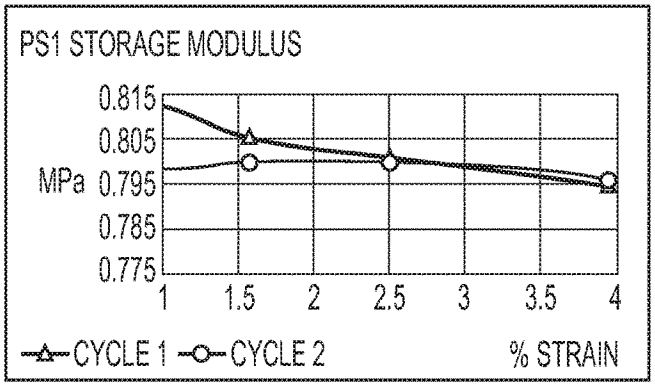
FIG. 1A is a diagram showing the storage modulus (vertical axis, unit MPa) in relation to strain (horizontal axis, unit %) in the elastomeric material sample PS1 in the dynamic mechanical analysis in Example 2.

The present invention is further explained in detail in connection with the figures.

In the present disclosure, "elastomeric material" (or plural form elastomeric materials) refers to a polymer that has viscoelasticity, relatively weak intermolecular forces, generally low Young's modulus, and high failure strain compared with other materials. The term may be used interchangeably with "elastomer." The polymers are amorphous and usually maintained above their glass transition temperature so that molecular reconformation without breaking the covalent bonds is feasible. At ambient temperatures, the elastomeric material is relatively soft and deformable.

In the present disclosure, the elastomeric materials may include thermoplastics, such as expanded polystyrene foam (EPS). Examples of the elastomeric materials also include styrene-butadiene copolymers, ethylene-propylene-diene copolymers, polyisoprene, polybutadiene, thermoplastics, polyisobutylene, polyisobutylene-isoprene copolymers, halogenated polyisobutylene-isoprene copolymers, nitrile-butadiene copolymers, or a combination thereof.

In one embodiment, the elastomeric material is a rubber vulcanizate that comprises rubber and rubber additives. The amount of the rubber additives in the rubber vulcanizate is 0.01 to 120 parts per 100 parts of the rubber. The types of rubber additives in the rubber vulcanizate can include filler (which can be carbon black), silica, protecting agent, tackifier, processing aid, pigment, activator, accelerator, vulcanizing agent, or a combination thereof Rubber additives are known in the art. Based on the types and amount as disclosed herein, one of skilled in the art of rubber compounding may select proper rubber additives to make the elastomeric material of the invention.

Fillers are particles added to materials that can improve specific properties or affect the tensile strength, toughness, heat resistance, color, clarity of the material. An example of the filler used in the elastomeric material is carbon black, and the amount of the filler in the elastomeric material is in the range of approximately 0 to 5 parts per 100 parts of rubber.

Silica, also known as silicon dioxide, is a compound that may be found in nature or exist as synthetic material. Silica may be added to the elastomeric material of the invention to modify its mechanical properties, and the amount of silica in the elastomeric material is in the range of approximately 3 to 14 parts per 100 parts of rubber.

Protecting agents are added to the elastomeric material to confer resistance to heat, sunlight, oxygen, and ozone. Examples of protecting agents used in the elastomeric material of the invention include antioxidants and antiozonant, such as paraphenylene diamines, hindered amines, hydroquinones, and hindered phenols. The amount of the protecting agent in the elastomeric material is in the range of approximately 1 to 7 parts per 100 parts of rubber.

Tackifiers are usually low-molecular weight compounds with high glass transition temperature that are added to increase the tackiness of the material. Examples of tackifiers are resins such as cycloaliphatic and aromatic resins, hydrogenated hydrocarbon resins, and terpene-phenol resins. The amount of the tackifier in the elastomeric material is in the range of approximately 1 to 12 parts per 100 parts of rubber.

Processing aids are added to increase the plasticity, fluidity, or lubrication of the elastomeric material. Examples of the processing aids are plasticizers which are added to soften the material in order to improve processing, lower viscosity, and increase flexibility of material. The amount of the processing aid in the elastomeric material is in the range of approximately 5 to 25 parts per 100 parts of rubber.

Pigments are added to bring different properties such as durability, resistance against heat and light, reinforcement capacity to the material. Examples of pigments include organic pigment powders, titanium dioxide, and bifunctional organic silicon compounds. The amount of the pigment in the elastomeric material is in the range of approximately 5 to 15 parts per 100 parts of rubber.

Activators are added to have a strong activation effect on the cross linking reactions of the rubbers, which results in enhanced vulcanization speed, increased cross-link density and reversion resistance, and improved dynamic properties. Examples of activators are zinc oxide and stearic acid. The amount of the activator in the elastomeric material is in the range of approximately 3 to 8 parts per 100 parts of rubber.

Accelerators are added to increase the speed of vulcanization and to permit vulcanization to proceed at lower temperature and with greater efficiency. Examples of accelerators are thiazoles, dithiocarbamates, thiurams, diphenylguanidine, and sulfenamides. The amount of the accelerator in the elastomeric material is in the range of approximately 0.05 to 6 parts per 100 parts of rubber.

Vulcanizing agents are added to cause the hardening of the elastomeric material. The most commonly used vulcanizing agent is sulfur; however, the term also evolves to include other vulcanizing agents such as zinc oxide, peroxides, and heat active resins. The amount of the vulcanizing agent in the elastomeric material is in the range of approximately 0.3 to 10 parts per 100 parts of rubber.

In the disclosure, "modulus" is a quantity that measures the material's resistance to being deformed when a stress is applied to it in a static strain cycle test. The modulus of the material is defined as the slope of its stress-strain curve in the elastic deformation region. The stiffer the material, the higher the modulus at a given strain.

In the disclosure, "storage modulus" (E') is a measure of the elastic response of a material in a dynamic strain test, and it measures the elastic component of the dynamic modulus of a material as commonly understood in the art. During the study of the viscoelasticity of the material using dynamic mechanical analysis, an oscillatory force (stress) is applied to the material and the resulting displacement (strain) is measured. In purely elastic materials, the stress and strain occur in phase, so that the response of one occurs simultaneously with the other; in purely viscous materials, there is a phase difference between stress and strain, where strain lags stress by a 90 degree phase lag. The viscoelastic materials disclosed herein exhibit some phase difference between stress and strain, a behavior somewhere in between that of purely viscous and purely elastic materials. The storage modulus of the material can be represented in the following expression:

$$E'=(\sigma_0/\varepsilon_0)\cos\delta,$$

where $\sigma_0$ is the initial stress; $\varepsilon_0$ is the initial strain; and $\delta$ is the phase lag between the stress and strain. Preferably, the elastomeric material for the golf grip has a storage modulus of less than 1.5 MPa, more preferably, less than 1.2 Mpa, and most preferably, less than 1.0 MPa. In one embodiment, the storage modulus of the elastomeric material for the golf grip is in a range of 0.790 to 0.815 MPa at the range of 1% to 4% strain.

Further, the elastomeric material used for the golf grip is a softer material, and the hardness of the elastomeric material is less than 35 durometer on the Shore A scale, preferably, less than 33 durometer on the Shore A scale, and more preferably, less than 31 durometer on the Shore A scale. In one embodiment, the hardness of the elastomeric material for the golf grip is 30 durometer on the Shore A scale.

As disclosed, the "dynamic strain test" is a test that is conducted at 30° C., a frequency of 1 Hz, and a strain sweep at 1-10% where test materials are strained for 5 minutes in the initial run (cycle 1), rested for 5 minutes, and then strained again for 5 minutes in the subsequent run (cycle 2). The test sample may be a piece of elastomeric material as prepared or a piece of material from a golf grip. The test is further described in Example 2.

As disclosed, the "static strain cycle test" is a test that is similar to the ASTM D412, Method A, having an initial strain cycle (cycle 1) and a subsequent strain cycle (cycle 2) as described in Example 3. In the initial strain cycle, each sample is strained to 300% under uniaxial static strain, and the force is measured. During the second strain cycle, each sample is again strained to 300% under the same uniaxial static strain, and the force is measured. Then, the data are normalized and plotted.

Further, the golf grip made of the elastomeric material exhibits the Payne effect and Mullins effect under dynamic mechanical analysis as further explained in Example 2. Moreover, the stable mechanical properties of the elastomeric materials are shown in the static strain cycle analysis in Example 3.

To adjust the viscoelasticity behavior and mechanical properties of the elastomeric material for making the golf grip, it is possible to adjust the proportions and types of rubber materials and rubber additives in the elastomeric material, incorporate specific types of modifiers for the viscoelastic behavior, process and treat the elastomeric material to change its mechanical properties, or any combination thereof. The practice of rubber compounding is well known in the art, and one may consult numerous publications by the American Society for Testing and Materials (ASTM). See R. J. Shaeffer, "Mechanical properties of rubber," web publication at https://www.mtec.or.th/wp-content/uploads/2018/04/mechanical-properties rubber.pdf (2018), the contents of which is incorporated herein by reference. Further guidance may be found at numerous publications, for example, Krishna C. Baranwal et al., "Basic Elastomer Technology," the Rubber division American Chemical Society, 1st Edition (2001).

Further, there are known techniques in the art to make a golf grip, and those techniques can be used as appropriate to make a golf grip from the elastomeric material. Based on the basic construction and structure of the golf grip, whether it's a single- or multiple-layered structure and whether the golf grip comprises uniformly distributed material or texture along the longitudinal axis of the golf club, one can use conventional means such as compression molding or injection molding to make the golf grip. As one example, it is possible to apply the elastomeric material as done in U.S. Pat. No. 9,676,094B1, which is incorporated herein by reference.

The elastomeric material can form a golf grip, and the golf grip can then be applied to the shaft of a golf club; or, the elastomeric material can be applied to the golf club to form a golf grip. The golf grip can be a single- or multiple-layered structure with variety of patterns to form a grip for the user. When the golf grip is a single-layered structure, the layer can comprise the disclosed elastomeric material. When the golf grip is multiple-layered structure, the disclosed elastomeric material forms one or more layers of the multiple layers. For example, the surface layer of the golf grip that is in contact with hands of the golfer can comprise the elastomeric material. For another example, the golf grip can comprise an inner layer being fit over a shaft of a golf club, and the inner layer can comprise the elastomeric material. For yet another example, an outer layer can be fashioned over the inner layer, the outer layer can comprise patterned or decorative materials, such as leather, alternative rubbers, among others.

The following examples further explain variations in the elastomeric materials that are within the scope of the present disclosure. One of skill in the art may further modify the examples without departing from the scope of the present disclosure.

Example 1. Making Elastomeric Material for the Golf Grip

Elastomeric materials are prepared according to the formulations as shown in Table 1 and common procedure as those described in Shaeffer (2018) and Krishna C. Baranwal et al. (2001). PS1 represents the formulation of one embodiment of the elastomeric material for making the golf grip of the present invention, and it is also divided into identical proportions PS1-1 and PS1-2 for testing as in Example 3; CS1, CS2, and CS3 represent standard formulations for the golf grip and are used as comparative samples, respectively; and CS3 is divided into identical proportions of CS3-1 and CS3-2 for testing as in Example 3. The amount of rubber additives is shown here as parts per 100 parts of rubber materials.

TABLE 1

Formulations of Elastomeric Material Testing Samples

| Formulations | | PS1 | CS1 | CS2 | CS3 |
|---|---|---|---|---|---|
| rubber | EPDM | 70-95 | 10-45 | 100 | 10-45 |
| | polyisoprene | 5-30 | 55-90 | 0 | 55-90 |
| rubber | carbon black | 0 | 5-15 | 5-15 | 5-15 |
| additives | silica | 3-14 | 10-35 | 15-45 | 10-35 |
| | protecting agent | 1-7 | 1-4 | 0 | 0 |
| | tackifier | 1-12 | 0 | 2-8 | 0 |
| | processing aid | 5-25 | 1-8 | 20-50 | 1-8 |
| | pigment | 5-15 | 0 | 0 | 0 |
| | activator | 3-8 | 3-15 | 3-8 | 3-15 |
| | accelerator | 0.8-4 | 0.8-4 | 0.8-4 | 0.8-4 |
| | vulcanizing agent | 0.3-4 | 1.5-5 | 0.3-4 | 1.5-5 |

Example 2. Dynamic Mechanical Analysis

The dynamic strain test is performed on 3 samples, PS1, CS1, and CS2 as formulated and prepared in Example 1 at 30° C., frequency of 1 Hz, and strain sweep at 1-10%. The samples are strained for 5 minutes in the initial run (cycle 1), rested for 5 minutes, and then strained again for 5 minutes in the subsequent run (cycle 2).

Figure 1B:
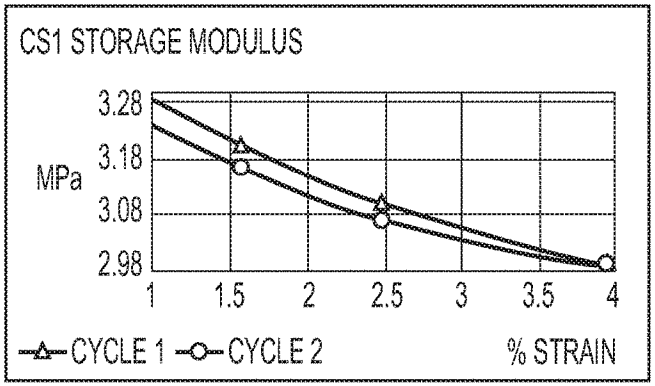
FIG. 1B is a diagram showing the storage modulus (vertical axis, MPa) in relation to strain (horizontal axis, %) in the first comparison material CS1 in the same example.
Figure 1C:
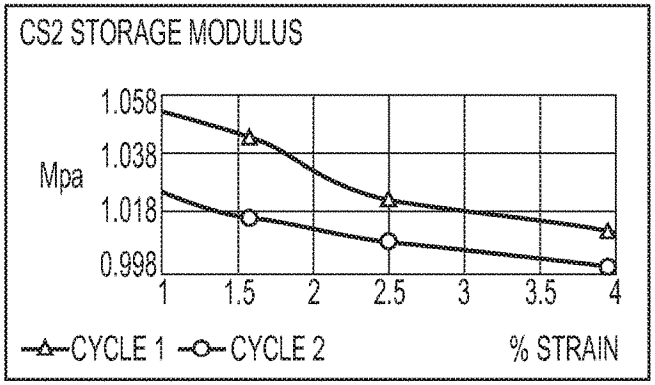
FIG. 1C is a diagram showing the storage modulus (vertical axis, MPa) in relation to strain (horizontal axis, %) in the second comparison material CS2 in the same example.
Figures 2, 3:
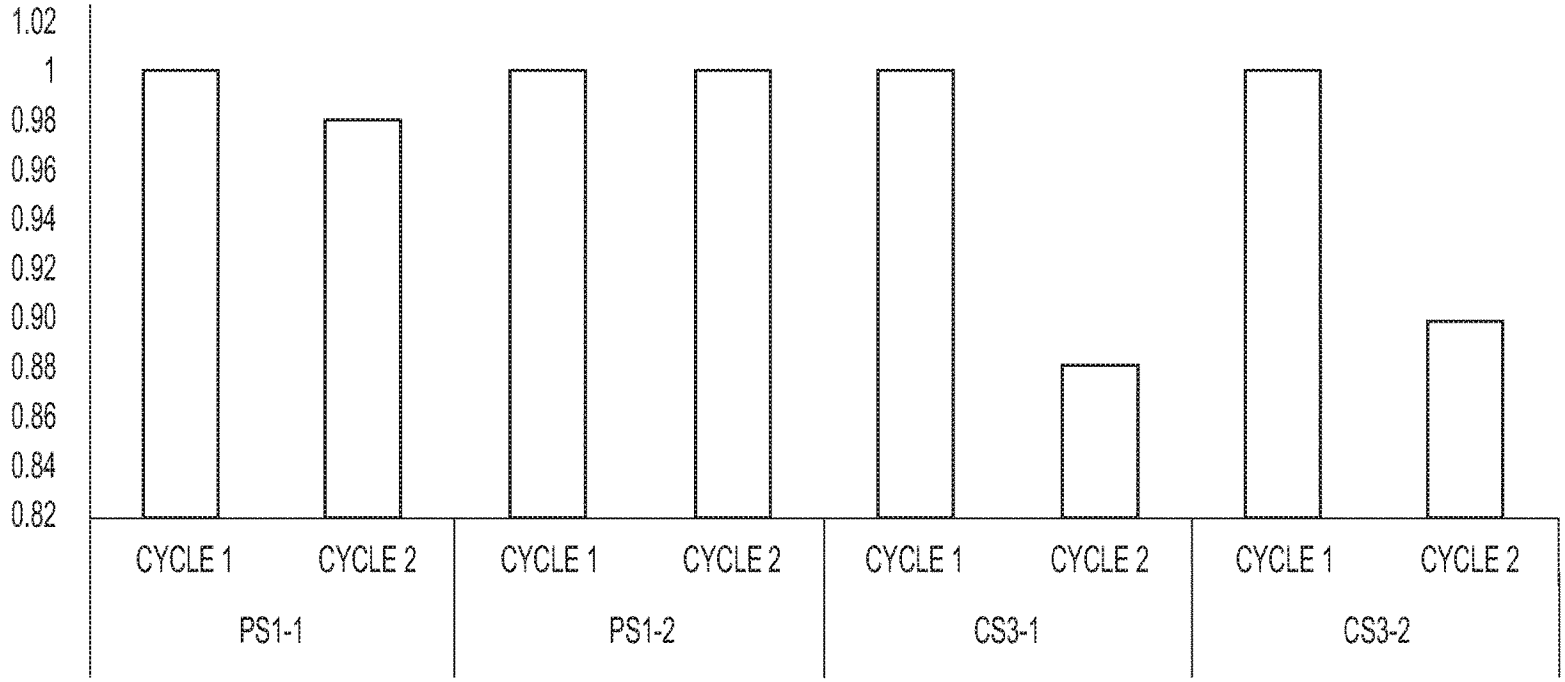
FIG. 2 is a table showing the storage modulus ΔE' (MPa) at cycle 1 and cycle 2 when the strain is within 1-4% and the difference in ΔE' (MPa) of cycle 1 and cycle 2 at 2.5% strain in samples PS1 in comparison to CS1 and CS2 as in Example 2.
FIG. 3 is a diagram showing and comparing the cycle normalized M300 (pounds per square inch, PSI) (vertical axis) under uniaxial static strain of the elastomeric material (PS1-1 and PS1-2) of the present invention and comparative examples (CS3-1 and CS3-2) in the static strain softening analysis in Example 3.

As shown in the diagrams in FIGS. 1A to 1C, PS1 (FIG. 1A) shows different viscoelastic behavior from the comparative samples CS1 (FIG. 1B) and CS2 (FIG. 1C). As indicated in the table of FIG. 2, after the initial run (cycle 1), PS1 of the present invention shows ΔE' of 0.0024 MPa at 1-4% strain in the subsequent run (cycle 2), while CS1 shows ΔE' of 0.2563 MPa and CS2 shows ΔE' of 0.0253 in the same run. Under the model of the Payne effect, PS1 of the present invention demonstrates almost no modulus decline from 1-4% strain, while CS1 suffers a modulus decline of about 106 times higher than that of PS1 and CS2 suffers a modulus decline of about 10 times higher than that of PS1. Thus, PS1 of the present invention shows very stable mechanical properties in comparison to comparative examples CS1 and CS2.

Further, as indicated in the right column of the table of FIG. 2, the change in the storage modulus ΔE' from cycle 1 to cycle 2 at 2.5% strain is 0.0010 for PS1, 0.0144 for CS1, and 0.0297 for CS2. Under the model of the Mullins effect, PS1 of the present invention demonstrates almost nearly repeatable viscoelastic behavior between the two loading cycle, while CS1 suffers a change in the modulus that is about 14 times bigger than that of PS1 and CS2 suffers a change in the modulus that is about 29 times bigger than that of PS1. Again, PS1 of the present invention shows very stable mechanical properties in comparison to comparative examples CS1 and CS2.

At the same time, the storage modulus of PS1 remains at 0.815 to about 0.790 MPa at the range of 1% to 4% strain, which is much lower than the range of the storage modulus of CS1 and CS2, showing that PS1 has not only stable mechanical properties but is a softer material than CS1 and CS2, making it an ideal material for golf grip to convey the soft fit feel with little deformation for precise golf shots for golfers.

Example 3. Static Strain Cycle Analysis

Sample materials PS1-1, PS1-2, CS3-1, and CS3-2 as described in Example 1 are tested under the static strain cycle test at an initial strain cycle (cycle 1) and a subsequent strain cycle (cycle 2) that is very similar to the ASTM D412 Method A. In the initial strain cycle, each sample is strained to 300% under uniaxial static strain, and the force is measured. The resting period is less than 1 minute. Then, during the subsequent strain cycle, each sample is again strained to 300% under the same uniaxial static strain, and the force is measured. The data are normalized by dividing the force of the first strain by the force of the second cycle.

As shown in FIG. 3 and data in the table of FIG. 4, both samples PS1-1 and PS1-2 show largely eliminated softening between cycle 1 and cycle 2 (0-2%), while comparative samples CS3-1 and CS3-2 both show noticeable softening under the uniaxial static strain (10-12%). Therefore, the elastomeric material for making the golf grip disclosed herein shows more stable mechanical properties than the comparative samples.

Other implementations will be apparent to those skilled in the art from consideration of the specification and practice of the examples disclosed herein. The examples disclosed herein are explanatory of the claimed invention and the examples do not restrict Applicant from claiming deviations therefrom.

I claim:

1. A golf grip, comprising an elastomeric material, wherein the elastomeric material has a change in storage modulus of less than approximately 0.01 MPa in a range of 1% to 4% strain in a subsequent test cycle after an initial test cycle in a dynamic strain test.

2. The golf grip of claim 1, wherein the elastomeric material has a change in storage modulus of less than approximately 0.007 MPa between the initial test cycle and the subsequent test cycle at 2.5% strain in the dynamic strain test.

3. The golf grip of claim 2, wherein the elastomeric material has a change in storage modulus of less than approximately 0.0035 MPa between the initial test cycle and the subsequent test cycle at 2.5% strain in the dynamic strain test.

4. The golf grip of claim 1, wherein the elastomeric material has a change in storage modulus of less than approximately 0.005 MPa in the range of 1% to 4% strain in the subsequent test cycle after the initial test cycle in the dynamic strain test.

5. The golf grip of claim 1, wherein the elastomeric material has a less than approximately 5% change in modulus when strained to 300% under a uniaxial static strain in a subsequent test cycle comparing to an initial test cycle under a static strain cycle test.

6. The golf grip of claim 1, wherein the elastomeric material has a less than approximately 2.5% change in modulus when strained to 300% under a uniaxial static strain in a subsequent test cycle comparing to an initial test cycle under a static strain cycle test.

7. The golf grip of claim 1, wherein the elastomeric material has a storage modulus of less than approximately 1.5 MPa at 2.5% strain.

8. The golf grip of claim 1, wherein the elastomeric material has a hardness of less than approximately 35 durometer on Shore A scale.

9. The golf grip of claim 1, wherein the golf grip comprises one or more layers, and at least one of the layers comprises the elastomeric material.

10. The golf grip of claim 1, wherein the elastomeric material comprises styrene-butadiene copolymers, ethylene-propylene-diene copolymers, polyisoprene, polybutadiene, thermoplastics, polyisobutylene, polyisobutylene-isoprene copolymers, halogenated polyisobutylene-isoprene copolymers, nitrile-butadiene copolymers, or a combination thereof.

11. The golf grip of claim 1, wherein the elastomeric material is a rubber vulcanizate, and the rubber vulcanizate comprises a rubber and rubber additives.

12. A golf grip, comprising an elastomeric material, wherein the elastomeric material has a change in storage modulus of less than approximately 0.007 MPa between an initial test cycle and a subsequent test cycle at 2.5% strain in a dynamic strain test.

13. The golf grip of claim 12, wherein the elastomeric material has a change in storage modulus of less than approximately 0.01 MPa in a range of 1% to 4% strain in the subsequent test cycle after the initial test cycle in the dynamic strain test.

14. The golf grip of claim 13, wherein the elastomeric material has a change in storage modulus of less than approximately 0.005 MPa in the range of 1% to 4% strain in the subsequent test cycle after the initial test cycle in the dynamic strain test.

15. The golf grip of claim 12, wherein the elastomeric material has a change in storage modulus of less than approximately 0.0035 MPa between the initial test cycle and the subsequent test cycle at 2.5% strain in the dynamic strain test.

16. The golf grip of claim 12, wherein the elastomeric material has a less than approximately 5% change in modulus when strained to 300% under a uniaxial static strain in a subsequent test cycle comparing to an initial test cycle under a static strain cycle test.

17. The golf grip of claim 12, wherein the elastomeric material has a less than approximately 2.5% change in modulus when strained to 300% under a uniaxial static strain in a subsequent test cycle comparing to an initial test cycle under a static strain cycle test.

18. The golf grip of claim 12, wherein the elastomeric material has a storage modulus of less than approximately 1.5 MPa at 2.5% strain.

19. The golf grip of claim 12, wherein the elastomeric material has a hardness of less than approximately 35 durometer on Shore A scale.

20. The golf grip of claim 12, wherein the golf grip comprises one or more layers, and at least one of the layers comprises the elastomeric material.

21. The golf grip of claim 12, wherein the elastomeric material comprises styrene-butadiene copolymers, ethylene-propylene-diene copolymers, polyisoprene, polybutadiene, thermoplastics, or a combination thereof.

22. The golf grip of claim 12, wherein the elastomeric material is a rubber vulcanizate, and the rubber vulcanizate comprises a rubber and rubber additives.

* * * * *